US011235484B2

(12) United States Patent
Penaflor

(10) Patent No.: US 11,235,484 B2
(45) Date of Patent: Feb. 1, 2022

(54) SAFETY RAZOR AND UTILITY CASE SYSTEM AND METHOD OF USE THEREOF

(71) Applicant: Ronaldo Green Penaflor, Fallbrook, CA (US)

(72) Inventor: Ronaldo Green Penaflor, Fallbrook, CA (US)

(73) Assignee: iP TECH PROS Inc., San Diego, CA (US)

( * ) Notice: Subject to any disclaimer, the term of this patent is extended or adjusted under 35 U.S.C. 154(b) by 78 days.

(21) Appl. No.: 15/930,397

(22) Filed: May 12, 2020

(65) Prior Publication Data

US 2020/0269454 A1 Aug. 27, 2020

Related U.S. Application Data

(63) Continuation-in-part of application No. 16/278,715, filed on Feb. 19, 2019, now Pat. No. 11,019,897, which is a continuation-in-part of application No. 16/257,044, filed on Jan. 24, 2019, now abandoned, which is a continuation-in-part of application No. 16/252,659, filed on Jan. 20, 2019, now Pat. No. 11,178,951.

(51) Int. Cl.

| | |
|---|---|
| ***B26B 21/40*** | (2006.01) |
| ***B26B 21/08*** | (2006.01) |
| ***B26B 21/52*** | (2006.01) |

(52) U.S. Cl.

CPC ..... *B26B 21/4012* (2013.01); *B26B 21/08* (2013.01); *B26B 21/521* (2013.01)

(58) Field of Classification Search

CPC ... B26B 21/4012; B26B 21/08; B26B 21/521; B26B 21/165

See application file for complete search history.

(56) References Cited

U.S. PATENT DOCUMENTS 3,488,673 A * 1/1970 Popeil ..... B26B 21/08 30/31
3,709,235 A * 1/1973 Washburn ..... A45D 34/00 132/290
3,754,326 A * 8/1973 Glaberson ..... B26B 21/40 30/40
4,141,445 A * 2/1979 Korich ..... B65D 83/40 206/228
4,258,471 A * 3/1981 Jacobson ..... B26B 21/521 30/530
4,281,455 A * 8/1981 Dixon ..... B26B 21/225 30/47
4,392,303 A * 7/1983 Ciaffone ..... B26B 21/521 30/526
4,428,116 A * 1/1984 Chen ..... B26B 21/521 30/47
4,480,387 A * 11/1984 d'Alayer de Costemore d'Arc ... A45D 27/46 30/41

(Continued)

*Primary Examiner* — Nicholas D Lucchesi

(57) ABSTRACT

Embodiments in this disclosure include a novel safety razor and utility case having a personal grooming utility case for storing a safety razor tool in a razor compartment and a disposable razor blade in a razor blade slot of the personal grooming utility case. The safety razor tool having a razor handle and a flexible razor jaw for receiving and safely removing the disposable razor blade from the razor blade slot of the personal grooming utility case.

5 Claims, 9 Drawing Sheets

(56) References Cited

U.S. PATENT DOCUMENTS 4,656,738 A * 4/1987 Corah ..... B65D 83/285 30/41
5,131,564 A * 7/1992 Pionkey ..... A47F 1/08 206/355
5,600,887 A * 2/1997 Olson ..... B26B 21/225 30/41.5
6,041,926 A * 3/2000 Petricca ..... B26B 21/24 206/356
6,421,925 B1 * 7/2002 Wonderley ..... B26B 21/4062 30/532
6,880,253 B1 * 4/2005 Gyllerstrom ..... B26B 21/222 30/527
9,801,503 B1 * 10/2017 Burk ..... A47K 1/09
2006/0080839 A1 * 4/2006 Hesketh ..... B26B 21/4012 30/50
2009/0193659 A1 * 8/2009 Park ..... B26B 21/4012 30/50
2011/0067245 A1 * 3/2011 Bridges ..... B26B 21/222 30/77
2012/0297625 A1 * 11/2012 Madden ..... B26B 21/225 30/42
2016/0144519 A1 * 5/2016 Hahn ..... B26B 21/225 30/50
2016/0250765 A1 * 9/2016 Gratsias ..... B26B 21/225 30/526
2016/0250766 A1 * 9/2016 Gratsias ..... B26B 21/14 30/526
2017/0021513 A1 * 1/2017 Liberatore ..... B26B 21/521
2017/0119126 A1 * 5/2017 Provost ..... A45D 27/225
2018/0128586 A1 * 5/2018 Warner ..... F42B 39/26
2019/0061186 A1 * 2/2019 Efthimiadis ..... B26B 21/521
2019/0126503 A1 * 5/2019 Greene ..... B26B 21/522
2019/0291289 A1 * 9/2019 Ren ..... B26B 21/40
2020/0406485 A1 * 12/2020 Kruemke ..... B26B 21/225
2021/0094198 A1 * 4/2021 Chatzigrigoriou ..... C08K 3/013
2021/0259384 A1 * 8/2021 McGarry ..... A45D 27/22
2021/0287239 A1 * 9/2021 Knight ..... B26B 21/4012

* cited by examiner

SAFETY RAZOR AND UTILITY CASE SYSTEM AND METHOD OF USE THEREOF

RELATED APPLICATIONS

This application claims the benefit of priority of U.S. application Ser. No. 16/252,659, filed Jan. 20, 2019, U.S. application Ser. No. 16/257,044, filed Jan. 24, 2019, and U.S. application Ser. No. 16/278,715, filed Feb. 19, 2019, which are herein incorporated by reference to the present application.

FIELD OF THE INVENTION

The present invention relates to a safety razor and utility case system. Particularly, the safety razor and utility case system includes a personal grooming utility case for storing a safety razor tool in a razor compartment and a disposable razor blade in a razor blade slot of the personal grooming utility case. The safety razor tool having a razor handle and a flexible razor jaw for receiving and safely removing the disposable razor blade from the slot of the personal grooming utility case.

BACKGROUND

Razors have been used throughout history and in many cultures. Modern types of razors include replaceable stainless steel blades capable of being used multiple times, reducing the cost of safety-razor shaving. Other types of razors include multi-blade cartridges and disposable razors. Safety feature may be incorporated into razors and razor blades which reduce the risk of being injured by the blades. Some of these blades include the disposable razors which have multiple flat blades that are planar to the surface of the razor blade, exposing only the tip of the blade and making it difficult to be insured or severely cut by the exposed blade edge.

Though these types of razors and many like them may have some desirable safety features, it is still lacking in other areas of safety and functionality when applied to other type of mobile and utility case applications.

SUMMARY

It is an advantage of the present invention to provide a safety razor and utility case system including a safety razor tool having a razor handle and flexible razor jaw coupled to the razor handle; and a personal grooming utility case having a plurality of personal care grooming compartments where the plurality of personal care grooming compartments may include at least a razor safety slot disposed on a first portion of the utility case for storing a disposable razor blade, and a razor compartment disposed on second portion of the utility case for storing the safety razor tool. The razor safety slot may include a razor insert opening through which the disposable razor blade is inserted and a razor access port through which the safety razor tool attaches to the disposable razor blade. In addition, the flexible razor jaw may include a first flexible razor arm, a second flexible razor arm coupled to the first flexible razor arm via a coupling member where a distal end of the first flexible razor arm may be separated from a distal end of the second flexible razor by a first width, a first razor jaw flexor wing coupled to the first flexible razor arm, and a second razor jaw flexor wing coupled to the second flexible razor arm. The flexible razor jaw may be configured to expand to a second width that is greater than the first width when an inward pressure is applied to the first razor jaw flexor wing and the second razor jaw flexor wing, and the flexible razor jaw may be configured to contract to the first width when no pressure is applied to the first razor jaw flexor wing and the second razor jaw flexor wing. The flexible razor jaw may be configured to receive the disposable razor blade when the flexible razor jaw is expanded to the second width, and the flexible razor jaw may be configured to securely attach to the disposable razor blade through the razor access port when the flexible razor jaw is contracted to the first width. The safety razor tool may be configured to safely remove the disposable razor blade from the razor safety slot in an upward direction through the razor insert opening.

It is another advantage of the present invention to provide a method for safely removing a safety razor from a utility case, the method including inserting a portion of the flexible razor jaw into the razor access port of the personal grooming utility case; applying an inward pressure to the first razor jaw flexor wing and the second razor jaw flexor wing so that the first flexible razor arm and the second flexible razor arm of the flexible razor jaw expand in width; inserting a first pin member and a second pin member disposed on the flexible razor jaw between two insertion gaps of the disposable razor blade while the flexible razor jaw is expanded; releasing the inward pressure from the first razor jaw flexor wing and the second razor jaw flexor wing so that the first flexible razor arm and the second flexible razor arm of the flexible razor jaw contracts in width, causing the first pin member and a second pin member to latch between insertion gaps of the disposable razor blade; and with an upward pulling motion of the razor handle, removing the disposable razor blade from the personal grooming utility case through the razor insert opening.

Some advantages of the safety razor and utility case system include 1} allowing multiple and a variety of different types of personal grooming tools to fit into the personal grooming utility case; 2) keeping and maintaining the safety razor tool and the disposable razor blade organized and in a fixed location, minimizing loss of parts; 3) providing additional safety by preventing a user from making contact with the sharp edges of the disposable razor blade when stored inside the razor blade slot of the personal grooming utility case; 4) having a single passage and method of removing the disposable razor blade, i.e., only the safety razor tool can attach and remove the disposable razor blade from the personal grooming utility case.

These and other objects, features and advantages of the present invention will become more apparent in light of the following detailed description of preferred embodiments thereof, as illustrated in the accompanying drawings.

BRIEF DESCRIPTION OF THE DRAWINGS

The present invention will be more clearly understood from the following detailed description of the preferred embodiments of the invention and from the attached drawings, in which.

In the appended figures, one or more elements may have the same reference numeral in different figures indicating previously described elements.

DETAILED DESCRIPTION

Embodiments in this disclosure include a novel safety razor and utility case system having a personal grooming utility case for storing a safety razor tool in a razor compartment and a disposable razor blade in a razor blade slot of the personal grooming utility case. The safety razor tool having a razor handle and a flexible razor jaw for receiving and safely removing the disposable razor blade from the razor blade slot of the personal grooming utility case. Benefits of the novel safety razor and utility case include 1) allows multiple and a variety of different types of personal grooming tools to fit into the personal grooming utility case; 2) keeps the safety razor tool and the disposable razor blade organized and in a fixed location, minimizing loss of parts; 3) provides additional safety by preventing a user from making contact with the sharp edges of the disposable razor blade when stored inside the razor blade slot of the personal grooming utility case; 4) only the safety razor tool can attach and remove the disposable razor blade from the personal grooming utility case.

Figure 1:
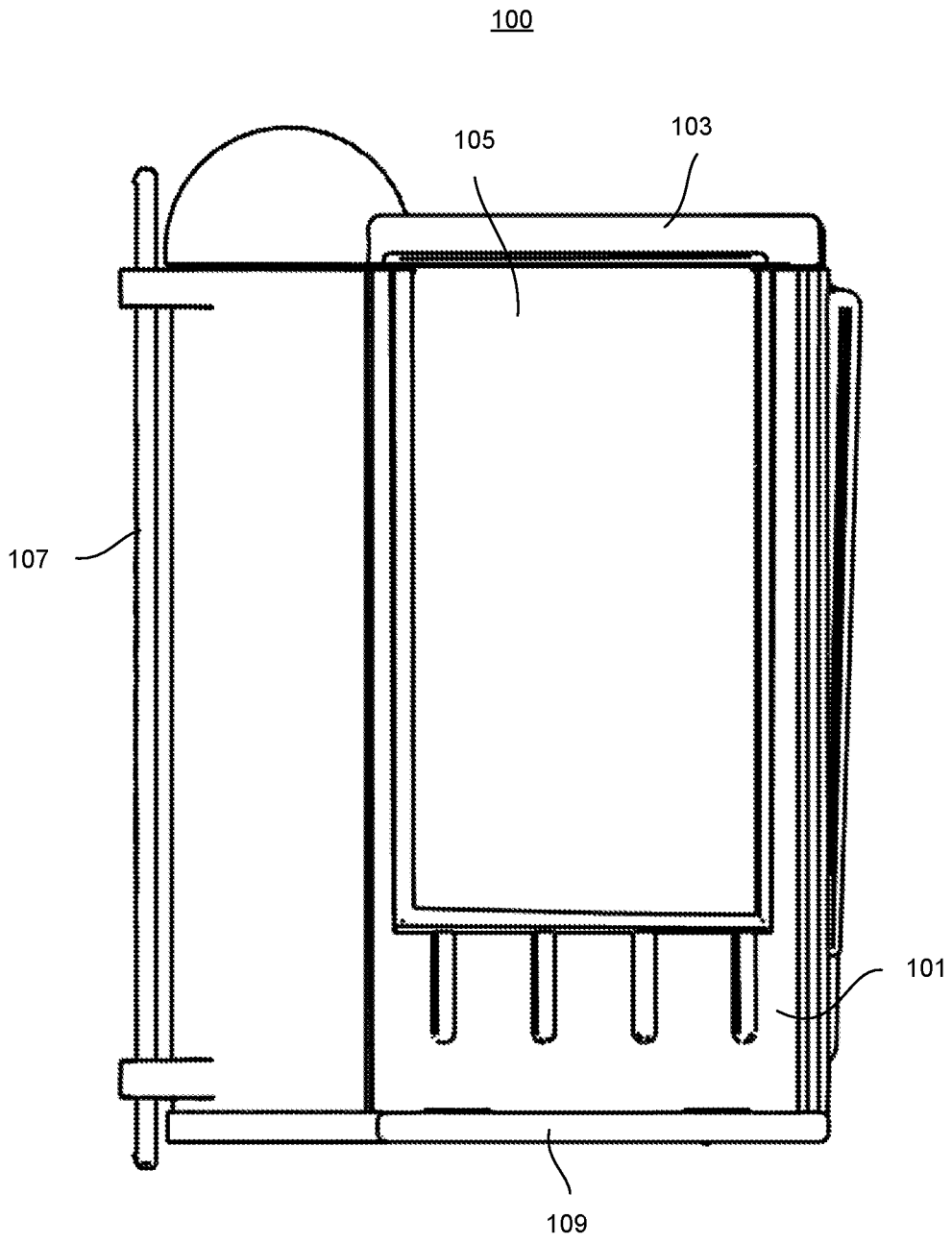
FIG. 1 illustrates a front facing view of a personal grooming utility case, according to an embodiment.

FIG. 1 illustrates a front facing view of a personal grooming utility case 100 having a utility storage body 101 for supporting a detachable lid and pivoting comb assembly 103, a mirror 105, a strap 107, and a base cover 109, according to an embodiment.

Figure 2:
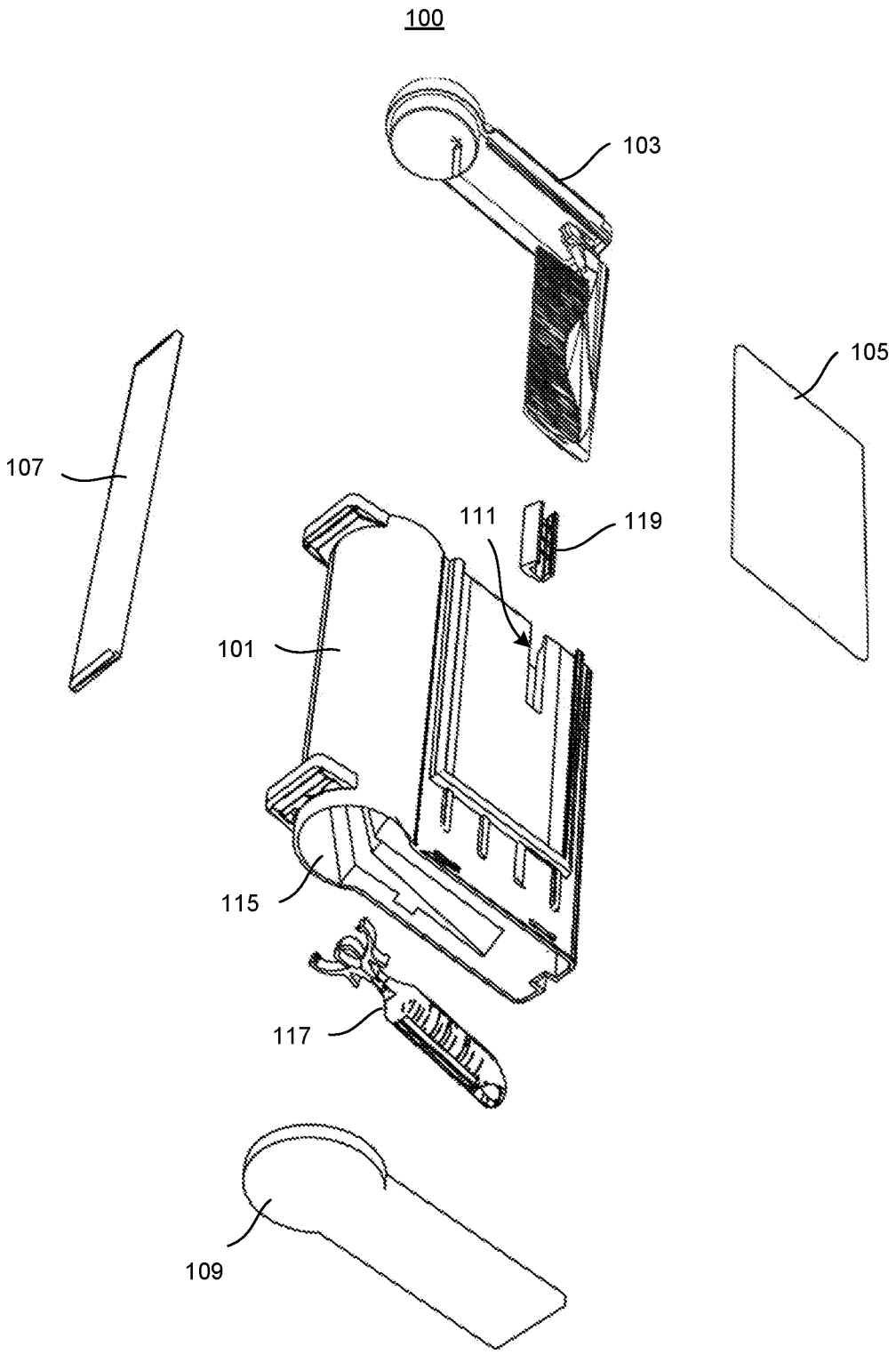
FIG. 2 illustrates a bottom perspective exploded view of the personal grooming utility case uncovering additional internal storage compartments, according to an embodiment.

FIG. 2 illustrates a bottom perspective exploded view of the personal grooming utility case 100 uncovering additional internal storage compartments, according to an embodiment. The personal grooming utility case 100 may also include additional internal storage compartments including, for example, a razor blade slot 111 disposed on a first portion of the personal grooming utility case 100 and a razor compartment 115 disposed on a second portion of the personal grooming utility case 100. The razor blade slot 111 may receive and securely hold a disposable razor blade 119 when inserted into the razor blade slot 111. In addition, the razor compartment 115 may fully receive and securely store a safety razor tool 117 as shown in FIG. 2 with the base cover 109 removed from the personal grooming utility case 100.

Figure 3A:
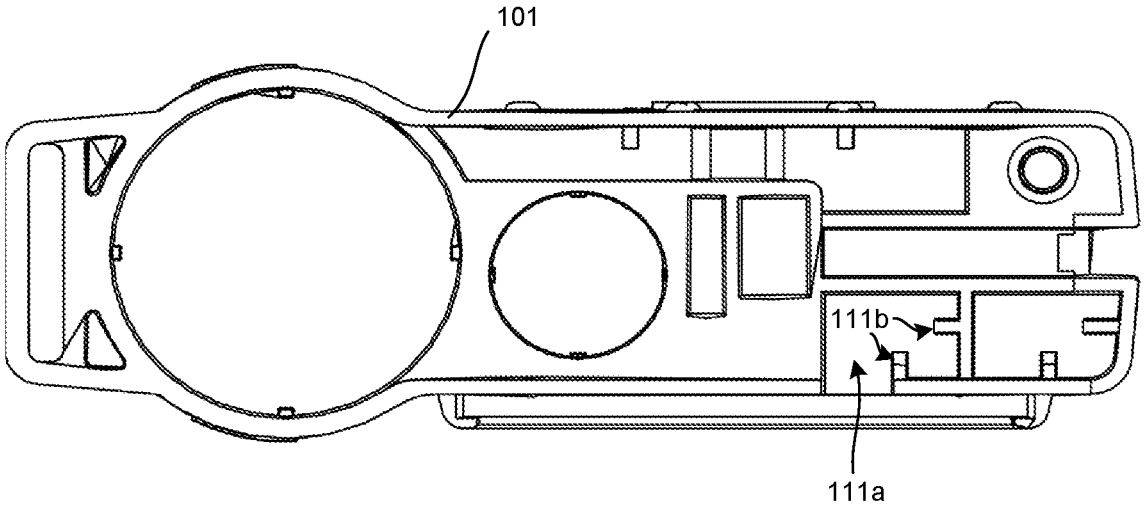
FIG. 3A and FIG. 3B illustrate a top view and a bottom view, respectively, of the utility storage body, according to an embodiment.
Figure 3B:
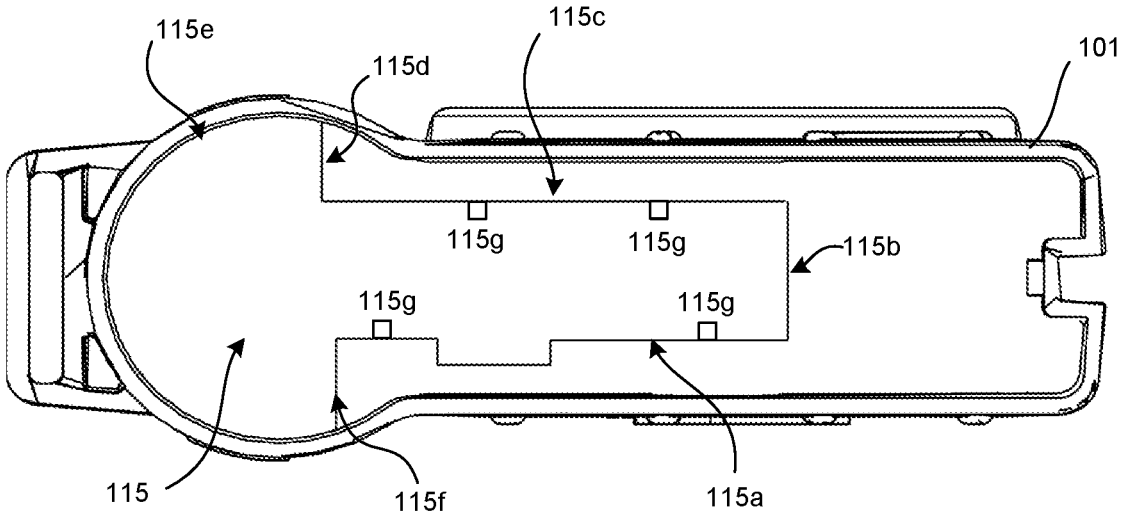

FIG. 3A and FIG. 3B illustrate a top view and a bottom view, respectively, of the utility storage body 101, according to an embodiment. As shown in FIG. 3A (top view), the razor blade slot 111 may include a razor insert opening 111*a* disposed on a top portion of the utility storage body 101, allowing a single passage of the disposable razor blade 119 into and out of the razor blade slot 111. The razor blade slot 111 may also include support tabs 111*b* formed along vertical sidewalls of the utility storage body 101 for providing additional support to secure the disposable razor blade 119 inside the slot, preventing it from accidently falling out when the detachable lid and pivoting comb assembly 103 removed and the personal grooming utility case 100 is turned upside down. As shown in FIG. 3B (bottom view), the razor compartment 115 may include multiple support walls (115*a*, 115*b*, 115*c*, 115*d*, 115*e*, 115*f*) disposed within an internal bottom portion of the utility storage body 101. The multiple support walls (115*a*, 115*b*, 115*c*, 115*d*, 115*e*, 115*f*) may also include support tabs 115*g* disposed along the internal bottom portion of the utility storage body 101 for securing the safety razor tool 117 to the razor compartment 115, preventing it from accidently falling out from the personal grooming utility case 100 when the base cover 109 is removed.

Figure 4B:
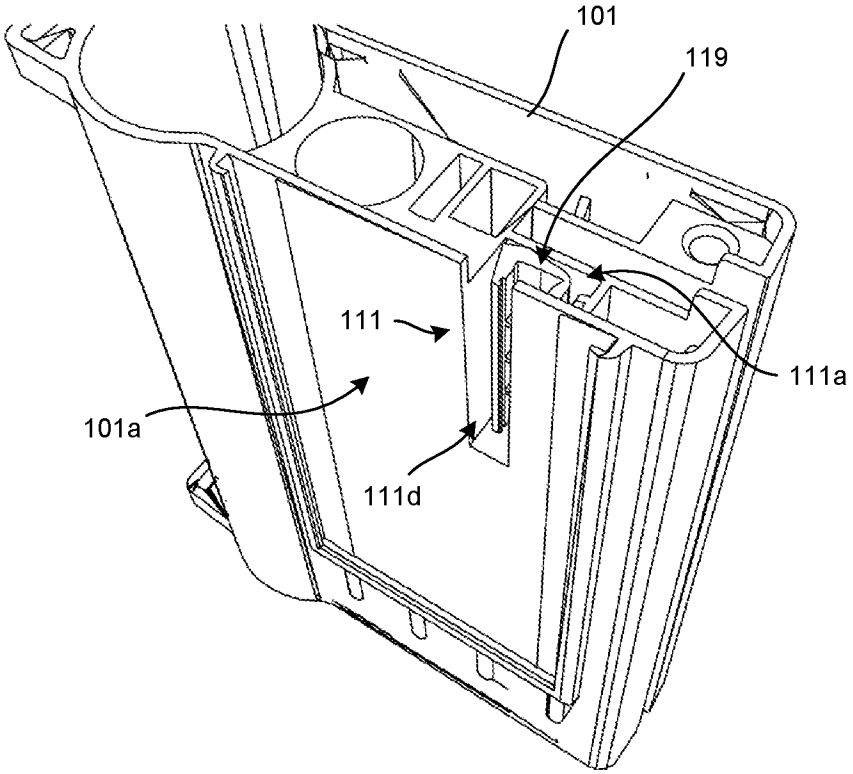
FIG. 4A and FIG. 4B illustrate a front view and a top front perspective view, respectively, of the utility storage body, according to an embodiment.
Figure 4A:
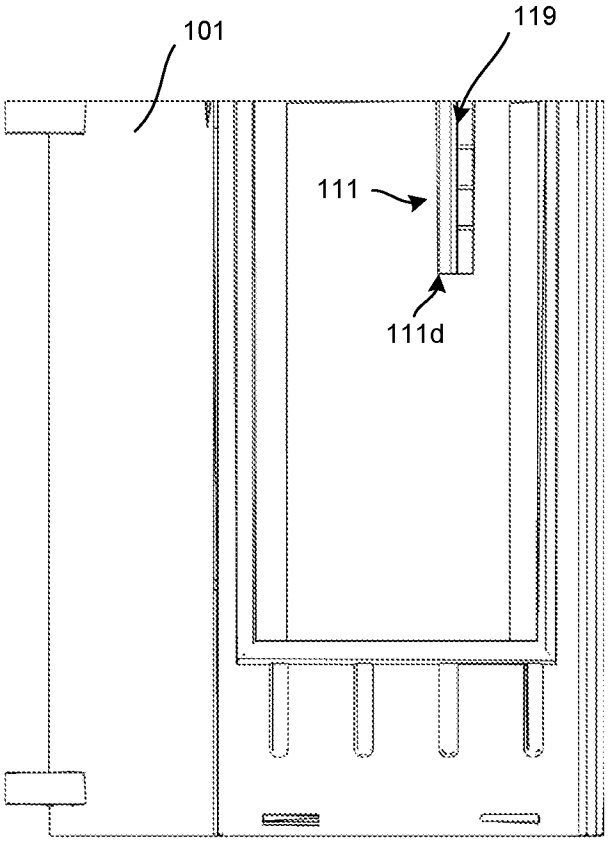

FIG. 4A and FIG. 4B illustrate a front view and a top front perspective view, respectively, of the utility storage body 101, according to an embodiment. The razor blade slot 111 may include a razor access port 111*d* having a narrow opening disposed along a panel 101*a* of the utility storage body 101. In application, the razor access port 111*d* may provide an opening for the safety razor tool 117 to access and attach to a portion of the disposable razor blade 119.

Figure 5B:
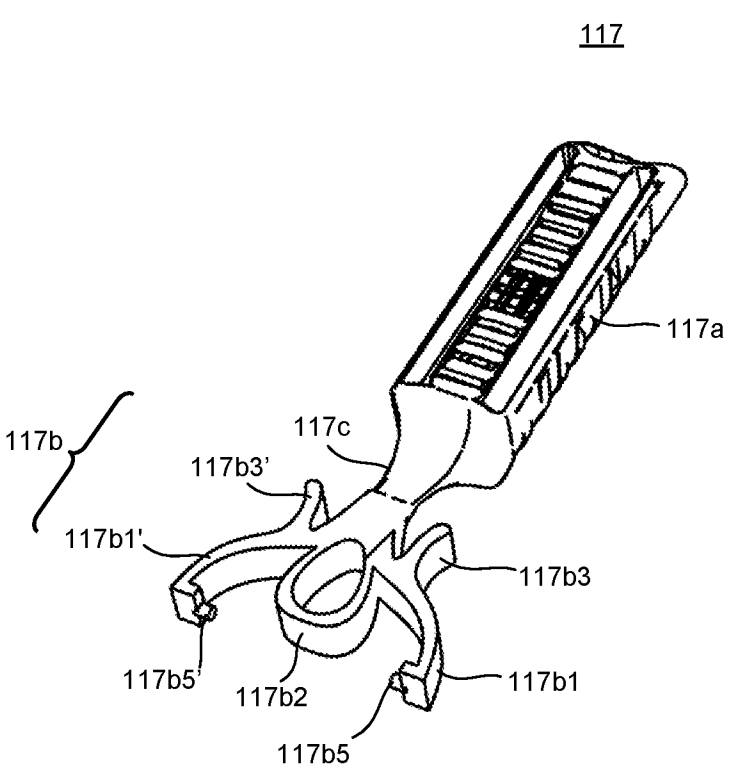
FIG. 5A and FIG. 5B illustrate a top view and a top perspective view, respectively, of the safety razor tool, according to an embodiment.
Figure 5A:
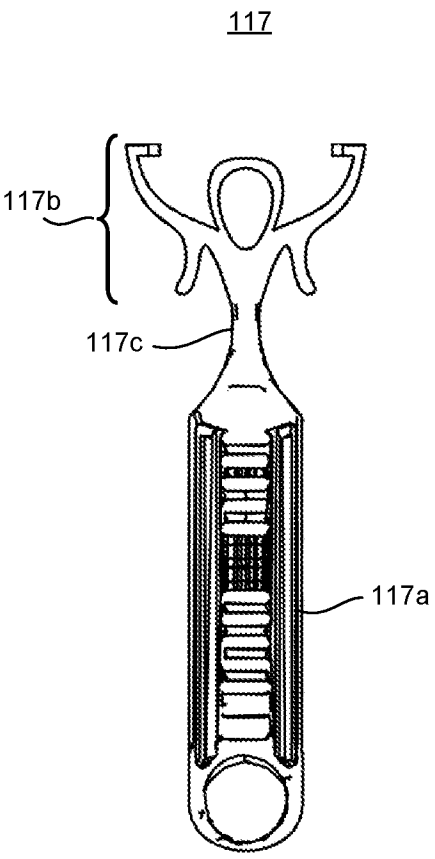

FIG. 5A and FIG. 5B illustrate a top view and a top perspective view, respectively, of the safety razor tool 117, according to an embodiment. The safety razor tool 117 may include a razor handle 117*a*, a flexible razor jaw 117*b*, and a razor neck 117*c* coupling the razor handle 117*a* to the flexible razor jaw 117*b* as shown in FIG. 5A. The flexible razor jaw 117*b* may include additional components such flexible razor arms (117*b*1, 117*b*'), a razor support base 117*b*2 attached between the flexible razor arms (117*b*1, 117*b*'), and razor jaw flexor wings (117*b*3, 1173') for expanding or contracting the width of the flexible razor arms (117*b*1, 117*b*'). In addition, each flexible razor arm (117*b*1, 117*b*') may include a razor attachment pin (117*b*5, 117*b*5') attached to a distal end of each flexible razor arm (117*b*1, 117*b*').

Figure 6B:
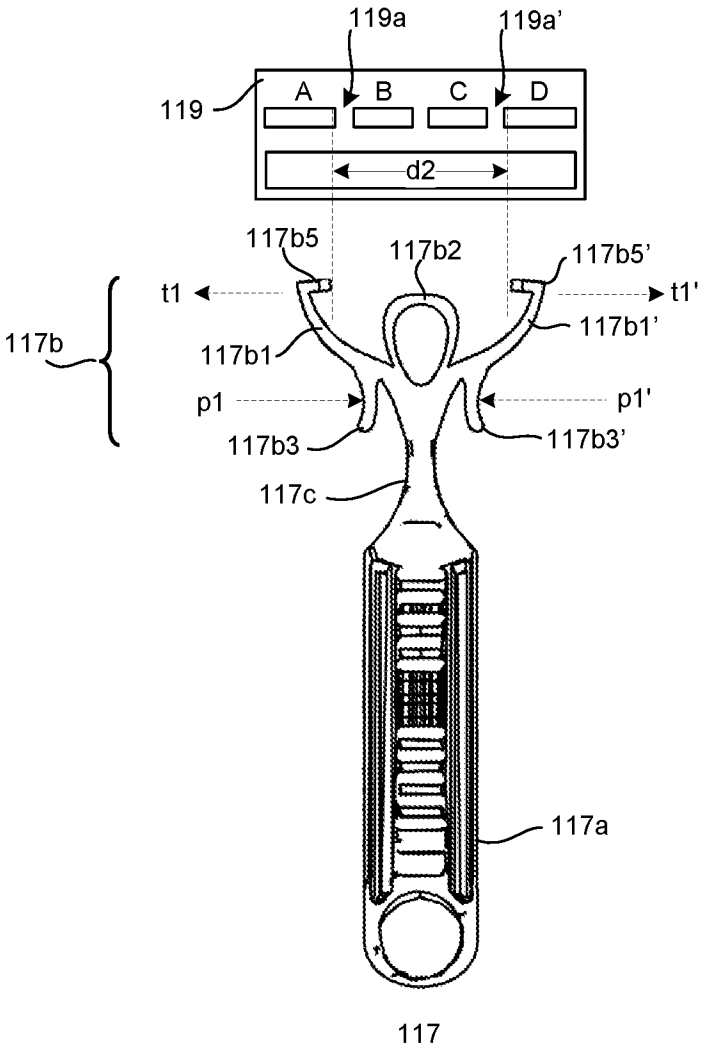
FIG. 6A and FIG. 6B illustrate top views of the disposable razor blade and the safety razor tool at a contracted state and an expanded state, respectively, according to an embodiment.
Figure 6A:
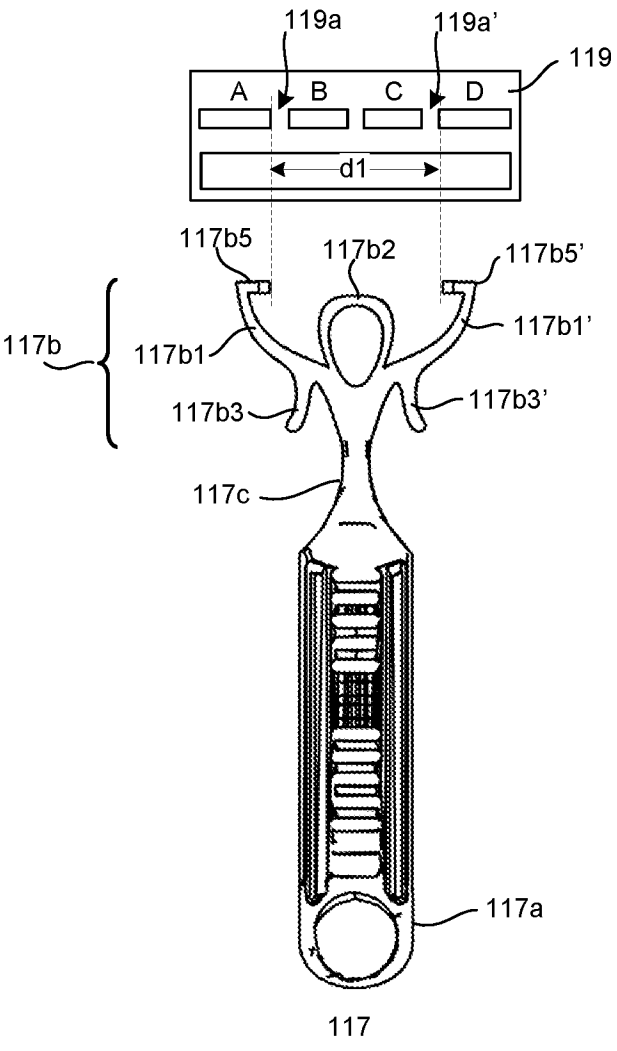

FIG. 6A and FIG. 6B illustrate top views of the disposable razor blade 119 and the safety razor tool 117 at a contracted state and an expanded state, respectively, according to an embodiment. In FIG. 6A, the flexible razor jaw 117*b* may include a first flexible razor arm 117*b*1, a second flexible razor arm 117*b*1' coupled to the first flexible razor arm 117*b*1 via a coupling member or razor neck 117*c* where a distal end of the first flexible razor arm 117*b*1 is separated from a distal end of the second flexible razor 117*b*1' by a first width d1, a first razor jaw flexor wing 117*b*3 coupled to the first flexible razor arm 117*b*1, and a second razor jaw flexor wing 117*b*3' coupled to the second flexible razor arm 117*b*1', the flexible razor jaw may be configured to expand to a second width d2 that is greater than the first width d1 when an inward pressure p1/p1' is applied to the first razor jaw flexor wing 117*b*3 and the second razor jaw flexor wing 117*b*3', where the flexible razor jaw 117*b* is configured to contract to the first width d1 when no pressure is applied to the first razor jaw flexor wing 117*b*3 and the second razor jaw flexor wing 117*b*3', where the flexible razor jaw 117*b* is configured to receive the disposable razor blade 119 when the flexible razor jaw is expanded to the second width d2, where the flexible razor jaw 117*b* is configured to securely attach to the disposable razor blade 119 through the razor access port 111*d* when the flexible razor jaw 117*b* is contracted to the first width d1, and where the safety razor tool 117 is configured to safely remove the disposable razor blade 119 from the razor safety slot 111 in an upward direction through the razor insert opening 111*a*. The disposable razor blade 119 may include multiple slots (A, B, C, D) disposed within the disposable razor blade 119 where slots A-B are separated by a first insertion gap 119*a* and slots C-D are separated by a second insertion gap 119*a*'. In the contracted state, as shown in FIG. 6A, when no inward pressure is applied to the razor jaw flexor wings (117*b*3, 1173'), the flexible razor jaw 117*b* has a nominal width d1 between the razor attachment pins (117*b*5, 117*b*5') that is less than spacing between gaps 119*a* and 119*a*'. In the expanded state, as shown in FIG. 6B, when an inward pressure (p1, p1') is applied to the razor jaw flexor wings (117*b*3, 1173'), the flexible razor arms (117*b*1, 117*b*') of the flexible razor jaw 117*b* also expands to a nominal width d2 between the razor attachment pins (117*b*5, 117*b*5') where d2 is greater than d1, allowing the razor attachment pins (117*b*5, 117*b*5') of the flexible razor jaw 117*b* to be inserted between insertion gaps 119*a*, 119*a'*.

Figure 7:
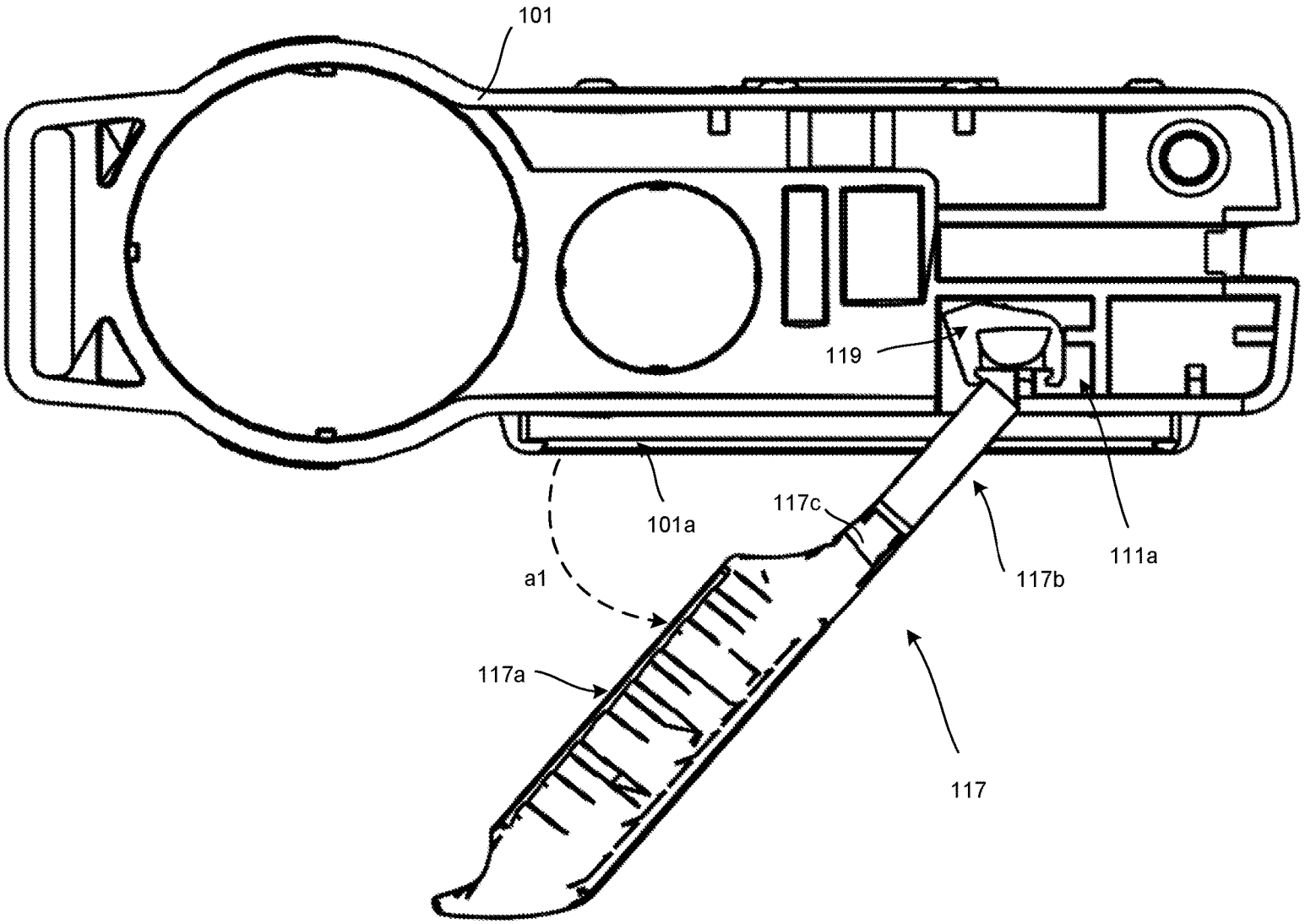
FIG. 7 illustrates a top view of the safety razor tool removing or inserting the disposable razor blade from the utility storage body, according to an embodiment.

FIG. 7 illustrates a top view of the safety razor tool 117 removing or inserting the disposable razor blade 119 from the utility storage body 101, according to an embodiment. Prior to removal or insertion of the disposable razor blade 119 from the utility storage body 101, the safety razor tool 117 is tilted at a tilt angle a1 formed between the panel 101*a* of the utility storage body 101 and a portion of the razor handle 117*a*, allowing the razor attachment pins (117*b*5, 117*b*5') to access the disposable razor blade 119 through the razor access port 111*d* of the utility storage body 101. In practice, the tilt angle a1 may range between 30 to 60 degrees, allowing the razor attachment pins (117*b*5, 117*b*5') adequate space to be inserted into the razor access port 111*d*.

Figure 8B:
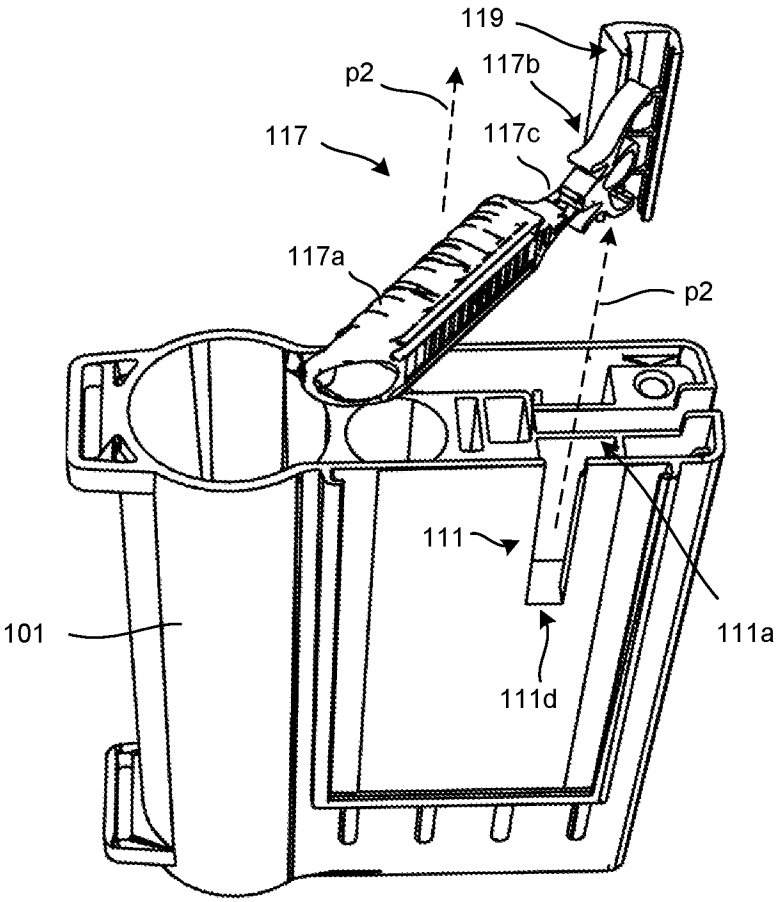
FIG. 8A and FIG. 8B illustrate front perspective views of a the disposable razor blade being removed from the utility storage body using the safety razor tool, according to an embodiment.
Figure 8A:
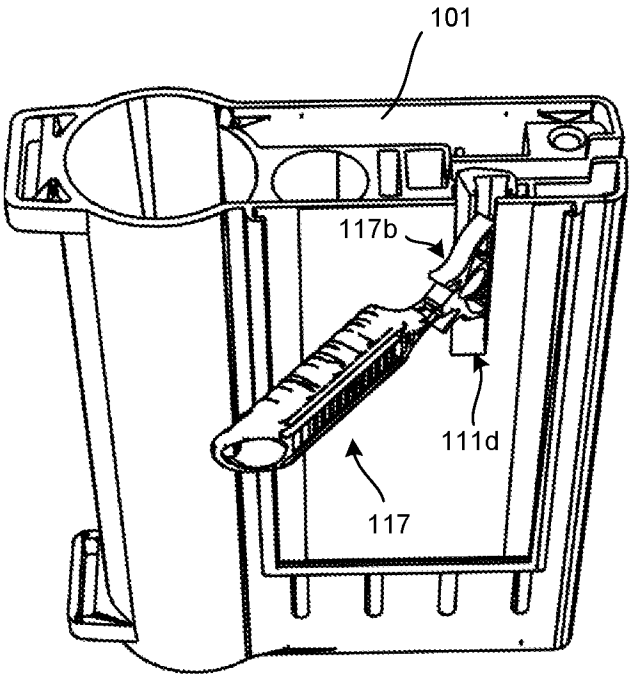

FIG. 8A and FIG. 8B illustrate front perspective views of a the disposable razor blade 119 being removed from the utility storage body 101 using the safety razor tool 117, according to an embodiment.

Figure 9:
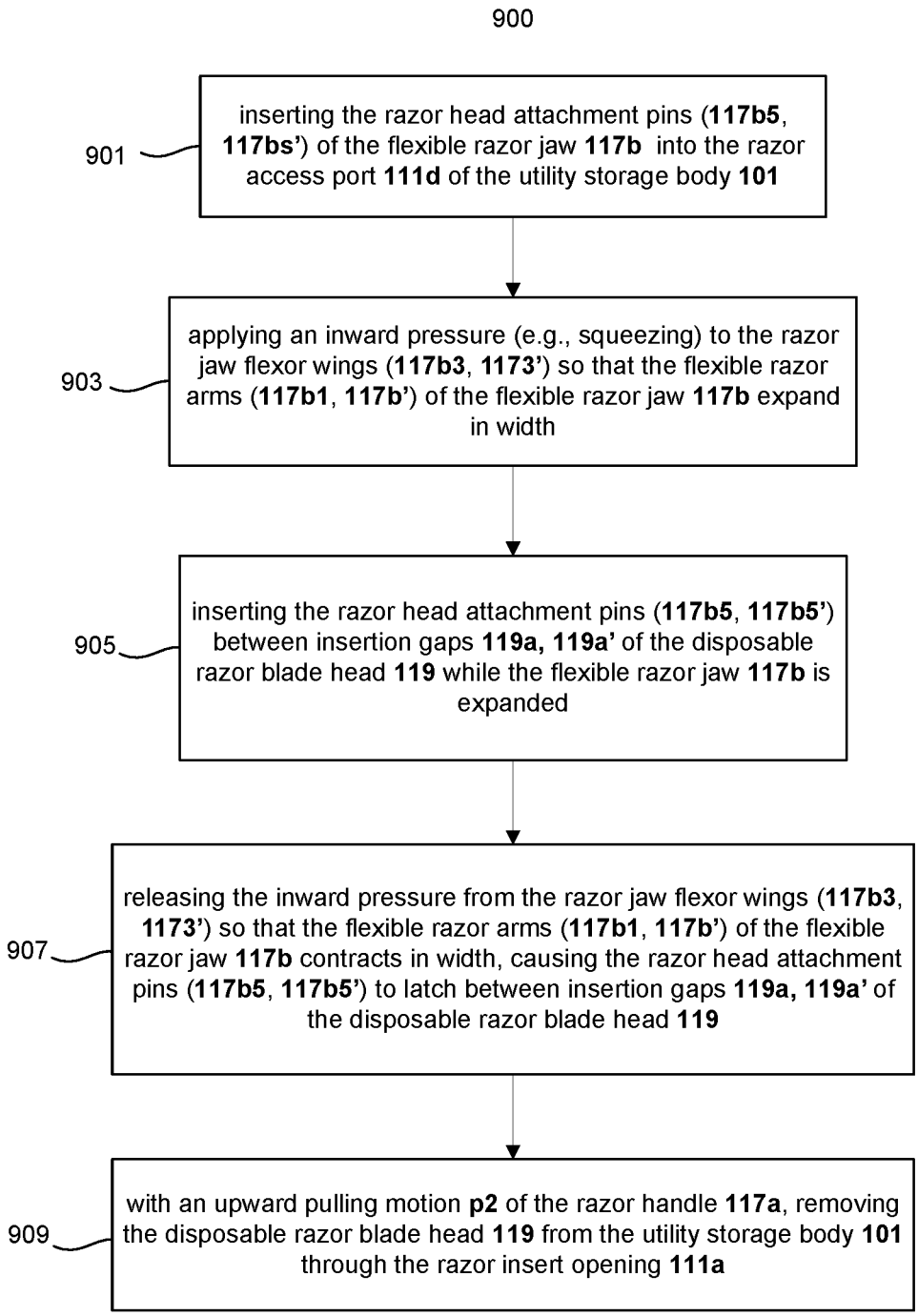
FIG. 9 illustrates a method of removing the disposable razor blade from the utility storage body using the safety razor tool, according to an embodiment.

FIG. 9 illustrates a method of removing the disposable razor blade 119 from the utility storage body 101 using the safety razor tool 117, according to an embodiment. First, inserting the razor attachment pins (117*b*5, 117*bs*') of the flexible razor jaw 117*b* into the razor access port 111*d* of the utility storage body 101 (Step 901). Note, tilting the razor handle 117*a* at a tilt angle a1 may allow easier access into the razor access port 111*d* of the utility storage body 101. Second, applying an inward pressure (e.g., squeezing) to the razor jaw flexor wings (117*b*3, 1173') so that the flexible razor arms (117*b*1, 117*b*') of the flexible razor jaw 117*b* expand in width (Step 903). Third, inserting the razor attachment pins (117*b*5, 117*b*5') between insertion gaps 119*a*, 119*a*' of the disposable razor blade 119 while the flexible razor jaw 117*b* is expanded (Step 905). Fourth, releasing the inward pressure from the razor jaw flexor wings (117*b*3, 1173') so that the flexible razor arms (117*b*1, 117*b*') of the flexible razor jaw 117*b* contracts in width, causing the razor attachment pins (117*b*5, 117*b*5') to latch between insertion gaps 119*a*, 119*a*' of the disposable razor blade 119 (Step 907). Finally, with an upward pulling motion p2 of the razor handle 117*a*, removing the disposable razor blade 119 from the utility storage body 101 through the razor insert opening 111*a* (Step 909).

In practice, the disposable razor blade 119 is made to be irremovable from the utility storage body 101 without applying the safety razor tool 117 to the disposable razor blade 119, providing safety to the user. In addition, the safety razor tool 117 has no additional parts (such as springs, gears, fasteners, hinges, etc.) and may be fabricated as a single unitary molded piece using plastic injection molding.

As used in the specification and the appended claims, the singular forms "a", "an", and "the" included plural referents unless the context clearly dictates otherwise.

All patents, patent applications, and other references cited herein are incorporated by reference in their entireties.

It is noted that the foregoing disclosure has been provided merely for the purpose of explanation and is in no way to be construed as limiting of the present invention. Although the present invention has been shown and described with respect to several preferred embodiments thereof, various changes, omissions, and additions to the form and detail thereof, may be made therein, without departing from the spirit and scope of the invention. It is understood that the words which have been used herein are words of description and illustration, rather than words of limitation. Changes may be made, within the purview of the appended claims, as presently stated and as amended, without departing from the scope and spirit of the present invention in its aspects.

Other embodiments and modifications of the present invention may occur to those of ordinary skill in the art in view of these teachings. Accordingly, the invention is to be limited only by the following claims which include all other such embodiments and modifications when viewed in conjunction with the above specifications and accompanying drawings.

What is claimed is:

1. A safety razor and utility case system comprising:

a safety razor tool having a razor handle and a flexible razor jaw coupled to the razor handle; and a personal grooming utility case having a plurality of personal care grooming compartments wherein the plurality of personal care grooming compartments includes at least a razor safety slot disposed on a first portion of the personal care grooming utility case for storing a disposable razor blade, and a razor compartment disposed on a second portion of the personal care grooming utility case for storing the safety razor tool, wherein the razor safety slot includes a razor insert opening through which the disposable razor blade is inserted and a razor access port through which the safety razor tool attaches to the disposable razor blade;

wherein the flexible razor jaw includes a first flexible razor arm, a second flexible razor arm coupled to the first flexible razor arm via a razor base support wherein a distal end of the first flexible razor arm is separated from a distal end of the second flexible razor arm by a first width, a first razor jaw flexor wing coupled to the first flexible razor arm, and a second razor jaw flexor wing coupled to the second flexible razor arm, wherein the flexible razor jaw is configured to expand to a second width that is greater than the first width when an inward pressure is applied to the first razor jaw flexor wing and the second razor jaw flexor wing, wherein the flexible razor jaw is configured to contract to the first width when no pressure is applied to the first razor jaw flexor wing and the second razor jaw flexor wing, wherein the flexible razor jaw is configured to receive the disposable razor blade when the flexible razor jaw is expanded to the second width, wherein the flexible razor jaw is configured to securely attach to the disposable razor blade through the razor access port when the flexible razor jaw is contracted to the first width, and wherein the safety razor tool is configured to safely remove the disposable razor blade from the razor safety slot in an upward direction through the razor insert opening.

2. The safety razor and utility case system of claim 1, wherein the flexible razor jaw is coupled to the razor handle via a razor neck.

3. The safety razor and utility case system of claim 1, wherein the first flexible razor arm is coupled to a first razor attachment pin and the second flexible razor arm is coupled to a second razor attachment pin.

4. The safety razor and utility case system of claim 1, wherein a razor support base is attached between the first flexible razor arm and the second flexible razor arm.

5. A method for safely removing a safety razor from a utility case, wherein the safety razor includes a safety razor tool having a razor handle and a flexible razor jaw coupled to the razor handle, wherein the flexible razor jaw includes a first flexible razor arm, a second flexible razor arm coupled to the first flexible razor arm via a razor base support wherein a distal end of the first flexible razor arm is separated from a distal end of the second flexible razor arm by a first width, a first razor jaw flexor wing coupled to the first flexible razor arm, and a second razor jaw flexor wing coupled to the second flexible razor arm, and the utility case includes a personal grooming utility case having a plurality of personal care grooming compartments wherein the plurality of personal care grooming compartments includes at least a razor safety slot disposed on a first portion of the personal grooming utility case for storing a disposable razor blade, and a razor compartment disposed on a second portion of the personal grooming utility case for storing the safety razor tool, wherein the razor safety slot includes a razor insert opening through which the disposable razor blade is inserted and a razor access port through which the safety razor tool attaches to the disposable razor blade, the method comprising:

inserting a portion of the flexible razor jaw into the razor access port of the personal grooming utility case;

applying an inward pressure to the first razor jaw flexor wing and the second razor jaw flexor wing so that the first flexible razor arm and the second flexible razor arm of the flexible razor jaw expand in width;

inserting a first pin member and a second pin member disposed on the flexible razor jaw between two insertion gaps of the disposable razor blade while the flexible razor jaw is expanded;

releasing the inward pressure from the first razor jaw flexor wing and the second razor jaw flexor wing so that the first flexible razor arm and the second flexible razor arm of the flexible razor jaw contracts in width, causing the first pin member and the second pin member to latch between the insertion gaps of the disposable razor blade; and with an upward pulling motion of the razor handle, removing the disposable razor blade from the personal grooming utility case through the razor insert opening.

* * * * *